United States Patent [19]

Serwatowski

[11] 4,232,652

[45] Nov. 11, 1980

[54] FIREPLACES OF THE TYPE HAVING FIREBOXES CONSTRUCTED OF FIREBRICK

[76] Inventor: Frank J. Serwatowski, 12155 Spencer Rd., Milford, Mich. 48042

[21] Appl. No.: 862,370

[22] Filed: Dec. 20, 1977

[51] Int. Cl.[3] ..... F24B 1/18

[52] U.S. Cl. ..... 126/120

[58] Field of Search ..... 126/120, 121, 299 R, 126/307 R, 8, 288, 142; D23/94

[56] References Cited

U.S. PATENT DOCUMENTS

| | | | |
|---|---|---|---|
| 1,436,750 | 11/1922 | Blackburn | 126/120 X |
| 1,755,771 | 4/1930 | Chambers | 126/120 |
| 1,830,073 | 11/1931 | Quist | 126/288 |
| 2,009,642 | 7/1935 | Jaquith et al. | 126/121 |
| 2,808,824 | 10/1957 | Cage | 126/120 |
| 4,015,587 | 4/1977 | Wincek | 126/288 X |

FOREIGN PATENT DOCUMENTS

| | | | |
|---|---|---|---|
| 661656 | 4/1963 | Canada | 126/120 |
| 2339215 | 2/1975 | Fed. Rep. of Germany | 126/120 |
| 7505131 | 11/1976 | Netherlands | 126/121 |

*Primary Examiner*—Lloyd L. King
*Assistant Examiner*—Harold Joyce
*Attorney, Agent, or Firm*—William L. Fisher; James M. Deimen

[57] ABSTRACT

An improvement in a fireplace of the type having a firebox constructed of firebrick, a metal damper mechanism on top of the firebox and a chimney having a chimney flue liner therein, the improvement comprising a prefabricated smoke chamber liner having front and side walls made of flat sheets of fire resistant material which are capable of being assembled and fastened together at the job site where the fireplace is being constructed, the smoke chamber liner assembled and disposed above the firebox and the downdraft cavity and below the chimney flue liner, the smoke chamber liner supported in the fireplace on brickwork with the front and side walls extending upwardly and inwardly from the firebox to the flue liner, and the front wall of the smoke chamber liner extending downwardly below the side walls to the damper.

1 Claim, 8 Drawing Figures

FIREPLACES OF THE TYPE HAVING FIREBOXES CONSTRUCTED OF FIREBRICK

My invention relates to fireplaces of the type having fireboxes constructed of firebrick and commonly called natural or manually made fireplaces.

The principal object of my invention is the provision of improvements in such fireplaces which make them more easily and expertly made even by amateurs.

Figure 1:
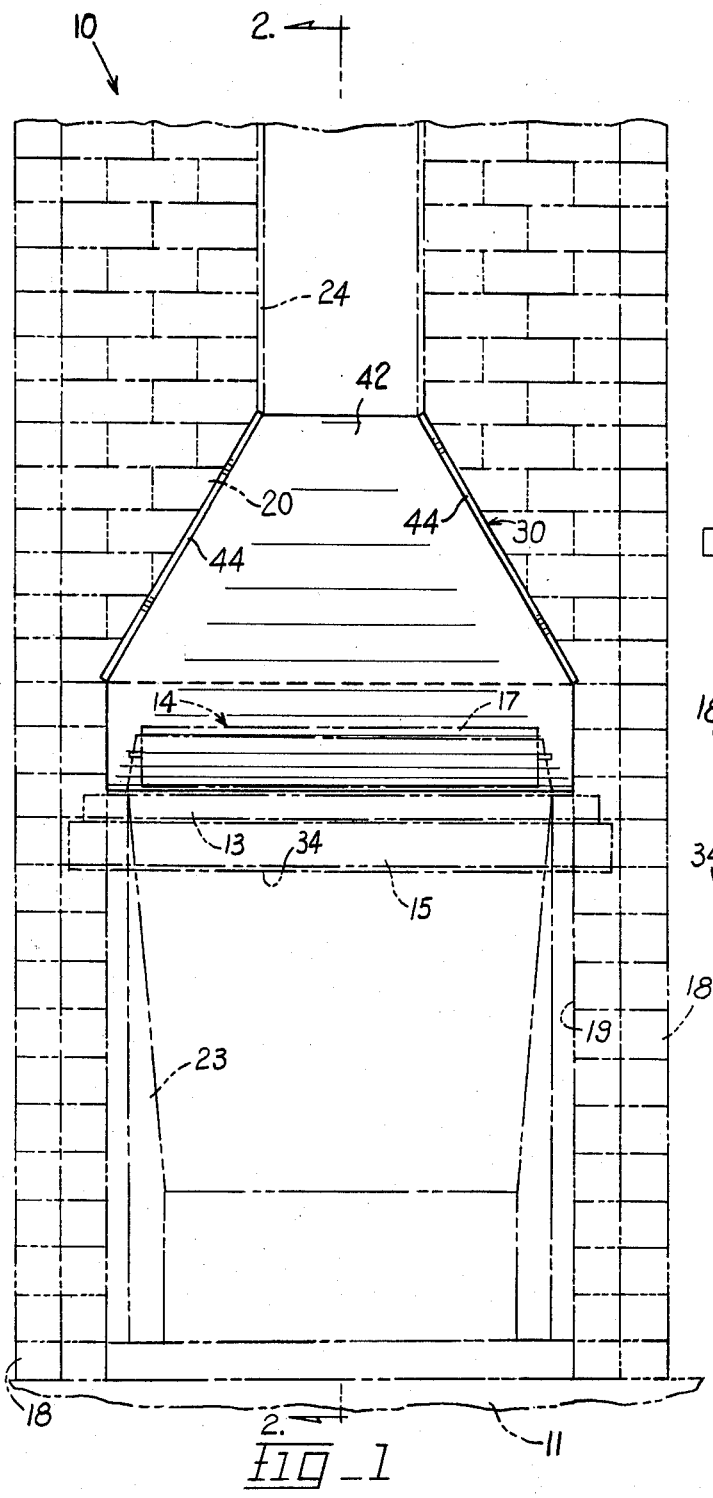
Figure 2:
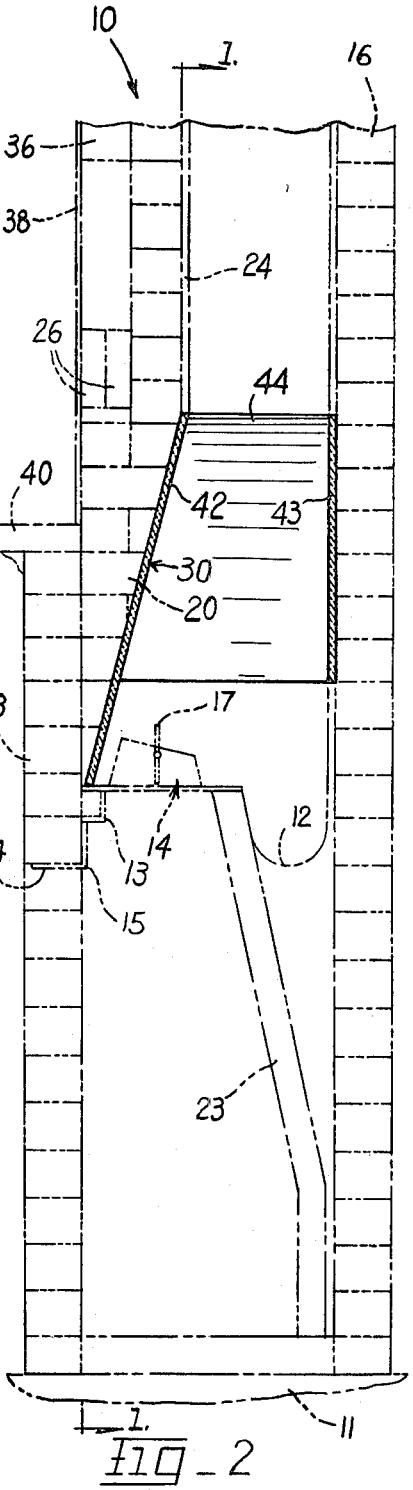
Figure 3:
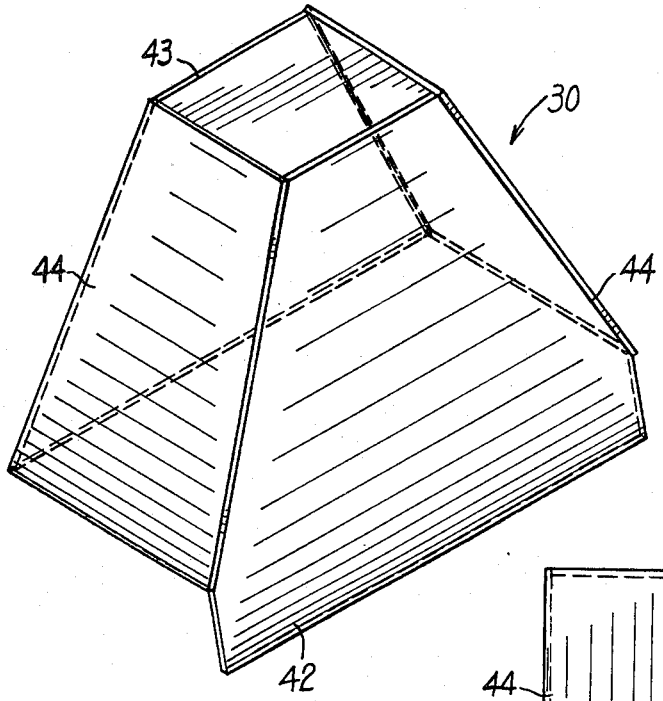
Figure 6:
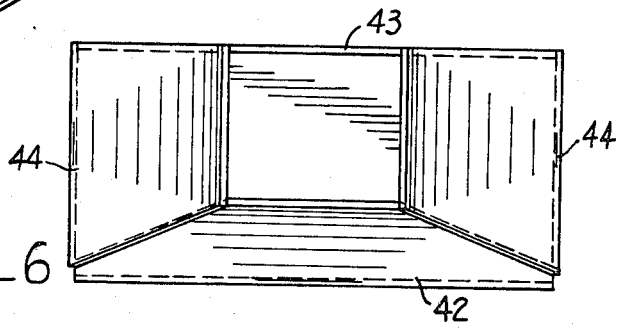
Figure 7:
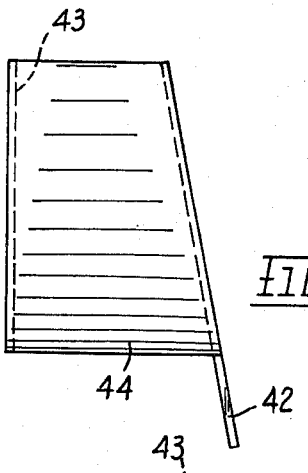
Figure 4:
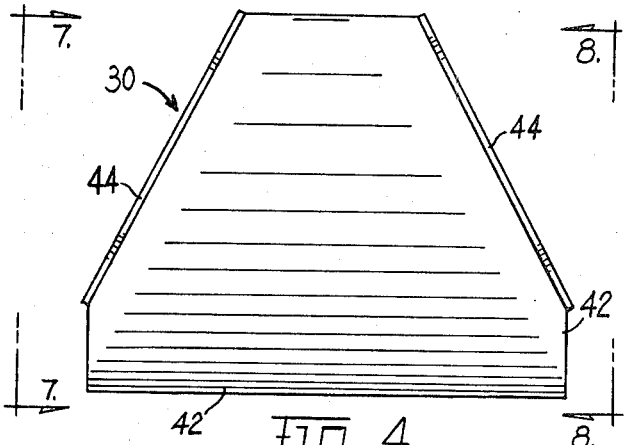
Figure 8:
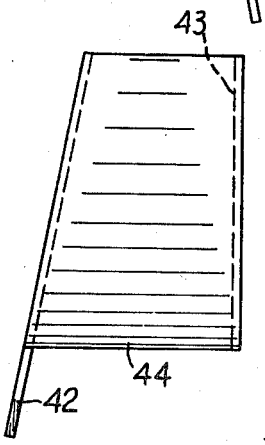
Figure 5:
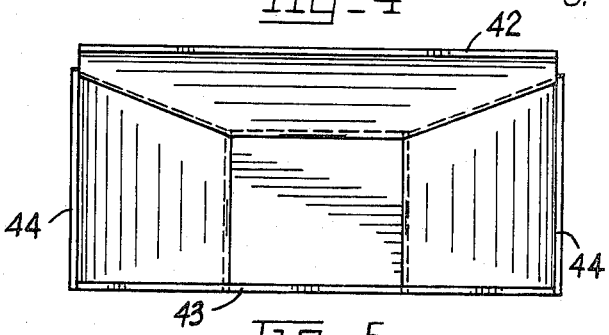

The foregoing object of my invention and the advantages thereof will become apparent during the course of the following description, taken in conjunction with the accompanying drawings, in which:

FIG. 1 and 2 are, respectively, fragmentary front and side elevational views of an improved fireplace embodying my invention; and FIGS. 3–8, respectively, perspective, front elevational, top and bottom plan, and opposite side elevational views of a part of the structure of FIGS. 1 and 2.

Referring to the drawings in greater detail, 10 generally designates said fireplace which is built upon a suitable foundation 11 and consists of a firebox 23 manually constructed of firebrick upon the top of which is mounted a metal damper mechanism 14 having a manually actuable damper 17 moveable in the usual manner by pull chains (not shown). The damper mechanism 14 is supported by an angle iron 13 resting on brickwork and another angle iron 15, likewise resting on brickwork, supports the upper wall of the fireplace room opening shown and indicated at 34. Behind the firebox 23 a rear wall of brick and mortar is built having an arcuate cavity 12 formed therein which serves as a return for downdraft air. The rear, side and front brick walls for the fireplace 10 are designated 16, 18 and 20, respectively. The fireplace 10 is provided with the usual chimney and flue liner therefor shown and indicated 24.

In accordance with my invention I provide a smoke chamber liner, generally designated 30, constructed of sheets of hard pressed asbestos which are assembled and fastened together at the job site where the fireplace is being constructed. Said smoke chamber liner 30 which has front, rear and side walls 42–44, respectively, is placed inside the fireplace 10 during building of the latter and bricked therearound. The smoke chamber liner 30 is supported in the fireplace 10 on its side walls 44 on brickwork so that its rear wall 43 is vertically disposed and the front wall 42 and side walls 44 extend upwardly and inwardly so that the top of said smoke chamber liner 30 corresponds with the opening for the flue liner 24 and the bottom thereof corresponds with that for the firebox 23. The front wall 42 extends below the other walls so as to rest upon the front end of the damper mechanism 14 to insure that there is proper clearance for the latter. As is common, wood framing

26, 28 and wood finishing 38 are provided, along with a mantle piece shown and indicated at 40, to finish the fireplace 10 on the room side thereof. Without the smoke chamber line 30 it is very difficult to construct a proper smoke chamber and requires a good deal of expertise; sometimes such smoke chambers end up with smoke leaks or improper interior walls which impede good draft or improper slant which interferes with operation of the damper.

It will thus be seen that there has been provided by my invention improvements in fireplaces in which the object hereinabove set forth, together with many thoroughly practical advantages, has been successfully achieved. For example, the speed and ease of construction of a fireplace is greatly increased and a smooth walled, leakproof smoke chamber with perfect slant is always insured and these good results can be consistently duplicated without fail for each fireplace constructed. While a preferred embodiment of my invention has been shown and described, it is to be understood that variations and changes may be resorted to without departing from the spirit of my invention as defined by the appended claims.

What I claim is:

1. Improvement in a fireplace of the type having a firebox constructed of firebrick, said fireplace having a chimney and a flue liner therefor and a metal damper mechanism on top of the firebox, said improvement comprising a prefabricated smoke chamber liner having front and side walls made of flat sheets of fire resistant material which are capable of being assembled and fastened together at the job site where the fireplace is being constructed, said fireplace having a downdraft cavity behind said firebox, said smoke chamber liner constructed to be disposed inside of the fireplace during building thereof above both the firebox and the downdraft cavity and below the chimney flue liner, said smoke chamber liner constructed to be supported in the fireplace on its side walls on brickwork so that its front and side walls extend upwardly and inwardly so that the top of said smoke chamber liner corresponds with the opening for the flue liner and the bottom thereof corresponds with that for the firebox, the front wall of said smoke chamber liner having an extension at the lower end thereof which projects downwardly and outwardly below the side walls thereof, said damper mechanism being of the type having a flat base which is horizontally disposed in said fireplace, said damper mechanism being disposed in the vertical space between the lower edges of said side walls and the lower edge of said extension, said lower edge of said extension being straight and engaging the flat base of the damper mechanism, and the opposite side edges of the extension being disposed in a vertical plane.

* * * * *